United States Patent [19]

Salzgeber

[11] 4,453,522

[45] Jun. 12, 1984

[54] APPARATUS FOR ADJUSTING THE TIMING OF A FUEL INJECTION PUMP

[75] Inventor: Daniel E. Salzgeer, Windsor, Conn.

[73] Assignee: Stanadyne, Inc., Windsor, Conn.

[21] Appl. No.: 144,033

[22] Filed: Apr. 28, 1980

[51] Int. Cl.[3] ..... F02M 59/20; F02M 59/32

[52] U.S. Cl. ..... 123/502; 123/179 L; 417/274; 417/462

[58] Field of Search ..... 123/502, 501, 179 L, 123/500, 506, 366; 417/274, 462, 285, 500

[56] References Cited

U.S. PATENT DOCUMENTS

| | | | |
|---|---|---|---|
| 3,204,622 | 9/1965 | Roosa | 123/502 |
| 3,704,963 | 12/1972 | Baxter | 417/274 |
| 3,861,833 | 1/1975 | Salzgeber | 417/462 |
| 4,052,971 | 10/1977 | Salzgeber | 417/462 |
| 4,079,719 | 3/1978 | Varcoe | 123/502 |
| 4,169,444 | 10/1979 | Kaibara | 123/502 |
| 4,273,090 | 6/1981 | Hofer | 123/502 |
| 4,333,437 | 6/1982 | Lohner | 123/179 L |
| 4,346,688 | 8/1982 | Kaibara | 123/502 |

FOREIGN PATENT DOCUMENTS 2638736 2/1978 Fed. Rep. of Germany .

*Primary Examiner*—Charles J. Myhre
*Assistant Examiner*—Carl Stuart Miller
*Attorney, Agent, or Firm*—Prutzman, Kalb, Chilton & Alix

[57] ABSTRACT

Apparatus is provided for temporarily advancing the timing of a fuel injection pump of the type having timing means responsive to a source of fuel under pressure correlated with the speed of an associated engine and also to the pressure of fuel in the pump housing. Valve means is provided for venting the pump housing which means may be manually or automatically actuated such as by use of a solenoid.

5 Claims, 5 Drawing Figures

APPARATUS FOR ADJUSTING THE TIMING OF A FUEL INJECTION PUMP

The present invention relates to fuel injection systems and equipment for internal combustion engines, particularly compression-ignition or diesel engines. The invention relates more particularly to apparatus for use with a fuel injection pump of the type commonly used in such systems to improve the regulation of the timing of the pump whereby engine efficiency and performance and benefitted and emission of smoke and hydrocarbons is decreased.

A fuel injection pump of the type to which the present invention is applied is arranged to be driven by an associated engine at a speed correlated with the engine speed and is provided with pumping plungers for delivering measured charges of fuel at high pressure to the engine cylinders successively. The plungers are usually actuated in timed relationship to the operation of the engine by cam means which is made adjustable so that the moment of injection of each charge can be made to occur slightly earlier in relationship to the operation of the engine, in which case the timing is said to be "advanced" or to occur slightly later in which case the timing is said to be "retarded."

It has been generally accepted heretofore that a compression-ignition or diesel engine will tend to exhibit better performance characteristics and have increased efficiency if the timing of the fuel injections to the engine cylinders is retarded at low engine speeds and advanced as speeds increase. A commonly used system to attain such regulation comprises means for actuating the timing means in response to fluid pressure which is generated in relationship to engine speed, a conventional source of such pressurized fluid being the output of the transfer or low pressure supply pump commonly used in fuel injection systems and driven by the engine to transfer fuel from a fuel supply tank or reservoir to the charge pump.

While during normal running of the engine, the above noted relationship between engine speed and timing of the fuel injections of the pump is desired, it has been found that there are exceptions when the engine is cold and is being started or driven at low speed. In those cases, the opposite is true and instead of being retarded, the timing of the fuel injection should be advanced for good performance and to decrease emission of smoke and hydrocarbons. Accordingly, there have been many proposals heretofore, such as the controls described in U.S. Pat. Nos. 4,122,813 and 4,143,632, for advancing timing during cold starting but such controls have generally been complicated in design and expensive to fabricate and have frequently failed to operate effectively.

Accordingly, it is an object of the invention to provide apparatus for use with a fuel injection pump in a fuel injection system which will make it possible in a simple and effective way to advance the timing of the fuel injection pump during cold start and slow running of the associated engine.

Another object is to provide such apparatus which is compatible with and does not interfere with the operation of the usual timing control under normal engine operating conditions.

A further object is to provide such apparatus which is inexpensive to fabricate and install and yet which is dependable in operation and which will provide readily reproducible results from pump to pump.

Other objectives will be in part obvious and in part pointed out in more detail hereinafter.

A better understanding of the invention will be obtained from the following description and the accompanying drawings of illustrative applications of the invention.

Figure 1:
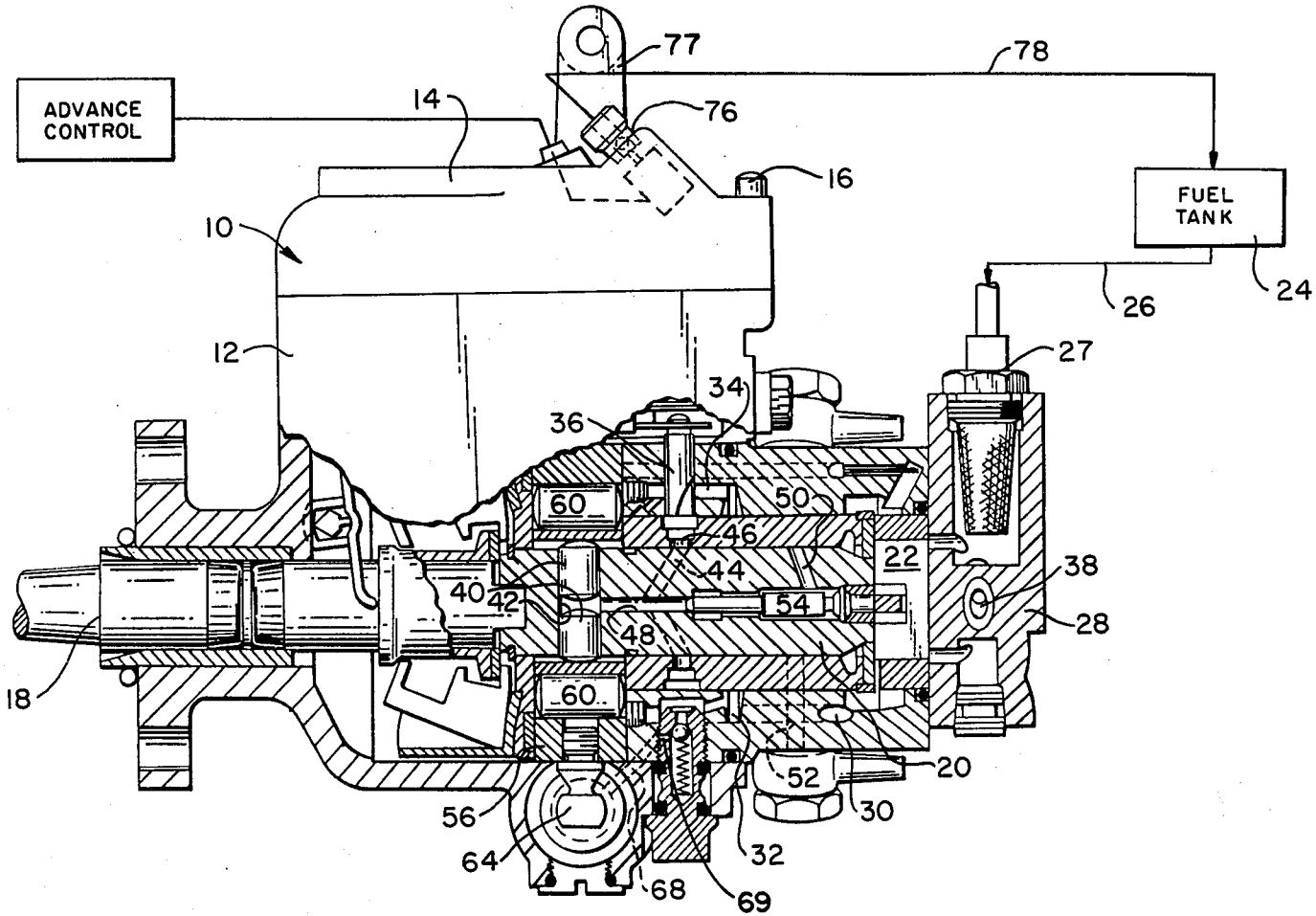
FIG. 1 is a partly schematic view of the timing adjustment apparatus in accordance with the invention, applied to an exemplary fuel injection pump, the fuel injection pump and apparatus attached thereto being shown in a longitudinal side elevational view, partly in section and partly broken away.

Referring now to the drawings in detail, the apparatus of the present invention is shown in association with a fuel injection pump 10 of the type shown and claimed in U.S. Pat. No. 3,704,963 granted Dec. 5, 1972 and assigned to the assignee of the present invention. The pump 10 is provided with a housing 12 having a sealed cover 14 secured thereto by screws 16. A drive shaft 18 adapted to be driven by an associated engine (not shown) is journaled in the housing 12 and is connected to and drives a fuel distributing rotor 20.

Connected to the outer end of rotor 20 is a vane-type low pressure transfer or supply pump 22 which receives fuel from a fuel supply tank or reservoir 24 connected by conduit 26 to a fuel inlet 27 in the headplate 28 and delivers the fuel under pressure via axial passageway 30, annulus 32 and passage 34 to metering valve 36. A pressure regulating valve 38 regulates the outlet pressure of the transfer pump 22 and returns excess fuel to the fuel inlet 27. The operation of the regulating valve 38 is such that the transfer pump output pressure increases in relationship to engine speed. A typical transfer pump regulated in this manner may, for example, produce a pump pressure of about 45 psi at 1200 rpm increasing to around 85 psi at 3200 rpm.

Plungers 40 mounted in the diametral bore 42 of the rotor 20 form a high pressure charge pump which receives metered inlet fuel from the metering valve 36 via diagonal passageway 44 which registers sequentially with spaced apart radial ports 46 (two shown) as the rotor 20 is rotated, and which delivers charges of fuel at high pressure via axial bore 48 to a radial passage 50 which registers sequentially with angularly spaced outlet passages 52 (one shown) which communicate with the engine fuel injection nozzles (not shown). A valve 54 disposed in the axial bore 48 is utilized to provide a sharp cut-off of fuel to the nozzles at the end of the pumping strokes.

The pumping action of the plungers 40 is achieved by means of an annular cam 56 having diametrically opposed camming lobes 58 which are engaged sequentially by rollers 60 carried by shoes 62 when the rotor is rotated. The rollers 60 and shoes 62 are mounted in the rotor 20 in alignment with the plungers 40 for engagement with the outer ends thereof whereby the plungers 40 are cammed inwardly to produce a pumping stroke each time the rollers engage a pair of opposite lobes 58. The annular cam 56 is mounted so that it can be angularly adjusted whereby the timing of the pumping strokes of the plungers 40 can be adjusted to occur slightly sooner (advanced) or slightly later (retarded) as the drive shaft 18 is rotated. The radially extending connector pin 64 provides means for rotatably shifting the cam 56 to adjust the timing.

In order to adjust the timing of the pumping strokes of the plungers 40 automatically in relationship to the speed of an associated engine, a cylinder 66 is provided in the housing 12 extending tangentially to and in the same plane as the annular cam 56. The right hand end of the cylinder 66 as viewed in FIG. 2 communicates via passage 68 with the axial output passageway 30 of the transfer pump, and the opposite end is vented through opening 70 to the interior of the housing 12. Slidably mounted in the cylinder 66 is a piston 72 which is connected to the connecting pin 64. A spring 74 seated at its outer end on an adjusting screw 75 urges the piston 72 to the right as viewed in FIG. 2.

Figure 2:
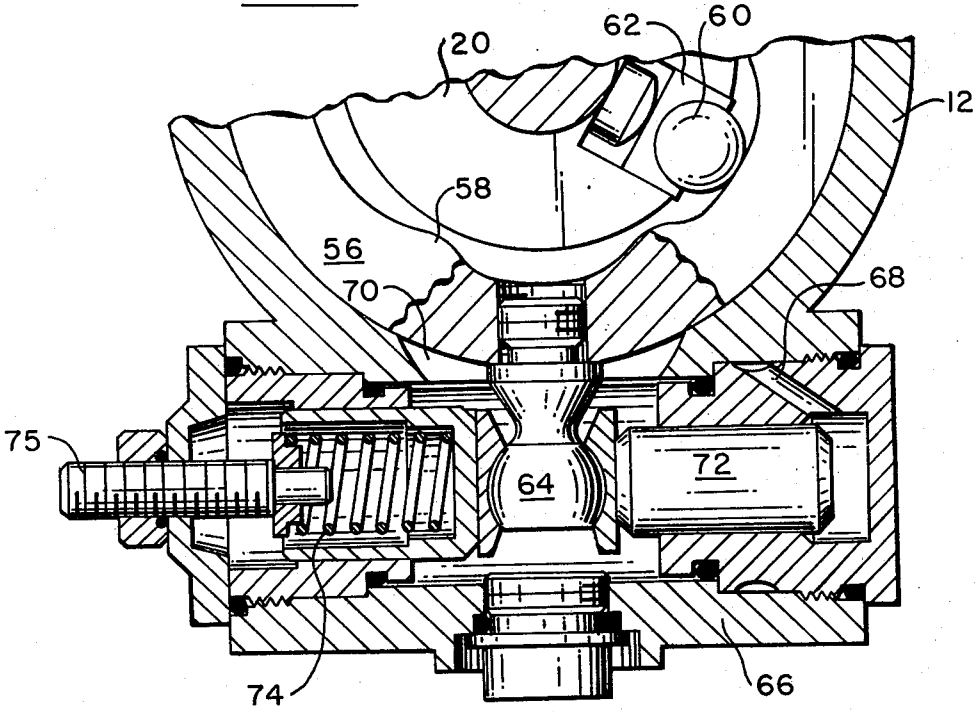
FIG. 2 is an enlarged longitudinal view, partly in section and partly broken away of the timing control and adjacent portions of the fuel injection pump shown in FIG. 1.

As will be apparent, when engine speed increases the fluid pressure applied to the right hand end of the piston 72 by the output of the transfer pump 22 will increase and drive the piston to the left as viewed in FIG. 2 which will angularly adjust the cam 56 in a direction to advance the timing of the pumping strokes of the plungers 40 and when engine speed decreases, the pressure on the right hand end of the piston will drop due to the lower fluid pressure output of the transfer pump 22 and the leakage of fuel through bleed orifice 69 enables the spring 74 to drive the piston 72 in the reverse direction thereby turning the cam 56 in a direction to retard the timing of the pumping strokes. This type of automatic timing means is well known and is commonly used in connection with fuel injection pumps of the type to which the present invention pertains.

The housing 12 has a vent opening 76 located at a part of the housing which is uppermost when the pump 10 is installed on the engine. Normally this opening is controlled by a normally closed pressure valve adapted to maintain a fluid pressure in the housing of about 8–10 psi and which will open and return excess fuel via fuel line 78 to the fuel tank 24 when the pressure exceeds this amount. Since this pressure is also maintained in the vented side of cylinder 66 because it is in communication with the interior of the housing at opening 70, this housing pressure assists the spring 74 in urging the piston 72 to the right as viewed in FIG. 2 in the direction for retarding the timing of the pumping strokes.

In accordance with this invention, means are provided for temporarily releasing or dumping the fluid pressure existing in the housing 12 to effect an advancement in timing under selected engine operation conditions, such as, for example, during cold starting and idling of the associated engine. As a specific example, it has been found that by dumping the housing pressure from 8 psi to 0 psi, the cam 56 can be angularly shifted by as much as 2° which, because the pump is rotated at one-half engine speed, represents a timing advance of 4° which is ample for the intended purpose.

Figure 3:
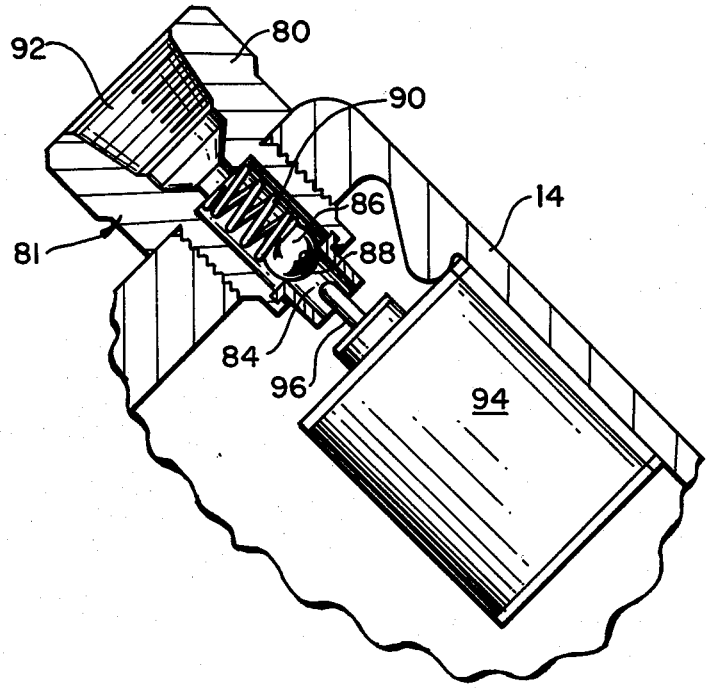
FIG. 3 is an enlarged longitudinal view partly in section of the control valve shown in FIG. 1.
Figure 5:
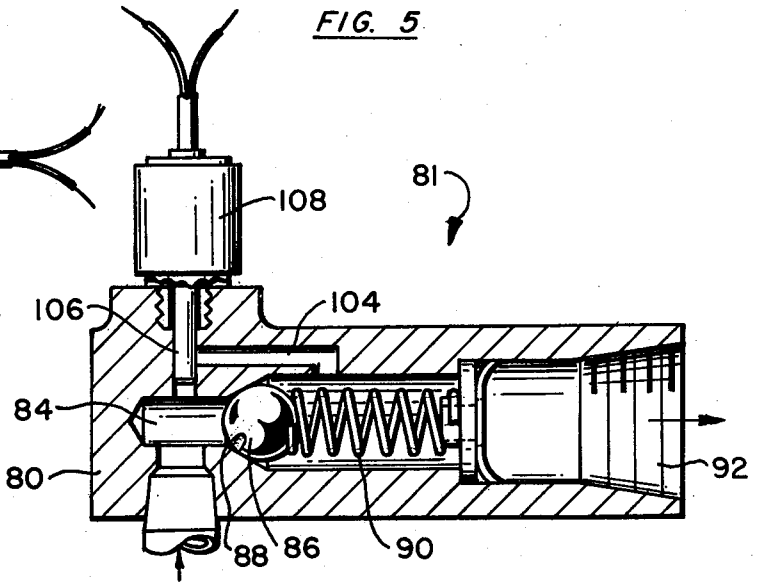
FIG. 5 is an enlarged longitudinal view partly in section of another modification of the control valve shown in FIG. 3.
Figure 4:
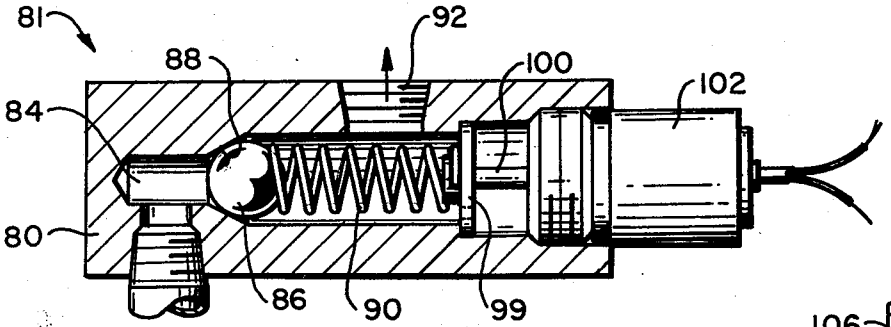
FIG. 4 is an enlarged longitudinal view partly in section of a modification of the control valve shown in FIG. 3.

While various means could be utilized for temporarily releasing the fluid pressure from the housing 12, I have shown in FIGS. 3–5 of the drawings, embodiments of a valve 81 which illustrates a preferred mode of carrying out the objects of the invention. These valves are intended to replace the conventional pressure valve normally connected to the vent opening 76 of the housing at a fixed housing pressure. These embodiments have in common a valve body 80 adapted to be connected to the threaded vent opening 76 and an internal passageway 84 normally closed by a ball 86 urged against a seat 88 by a spring 90 and having an outlet 92 for connection to the fuel line 78 which returns released fuel to the fuel tank 24.

In the embodiment shown in FIG. 3, the valve may be temporarily opened to vent the fluid pressure from the housing by energizing a solenoid 94 having a plunger 96 extending into the passageway 84 and adapted to engage and unseat the ball 86 when the solenoid is energized.

In the embodiment shown in FIG. 4, the spring 90 urging the ball 86 against the seat 88 is seated at its outer end against spring seat 99 provided at the end of plunger 100 of a solenoid 102. When the solenoid 102 is energized, the plunger 100 is withdrawn until the spring seat bottoms against the end of the solenoid to release the bias of spring 90 on ball 86 to allow the ball to become unseated.

In the embodiment shown in FIG. 5, the valve body 80 is provided with a by-pass passageway 104 which is normally closed by the plunger 106 of the solenoid 108. When the solenoid 108 is energized, the plunger 106 is withdrawn permitting the fluid pressure to escape via passageway 104 around the seated ball 86.

As will be apparent, the solenoids of the valves 81 can be operated by any suitable control means depending upon the conditions under which temporary advancement of the timing is desired. In the simplest embodiment, the control means could be a manually operated switch but for automatic operation such as in response to engine temperature the solenoid could preferably be operated, for example, by a control circuit which senses the coolant temperature of the engine. Another example of suitable control means could be a mechanical device responsive to the position of the engine throttle lever 77 to unseat ball 86 (FIG. 3) or actuate plunger 106 (FIG. 5). An inherent advantage of utilizing the solenoid release function of the specific embodiments described above is that they operate in a fail-safe manner in that if the solenoid fails to function, the normal pressure will be maintained in the housing 12 and control of the timing in response to engine speed will not be interfered with.

Modifications, adaptations and variations of the foregoing specific disclosure will be apparent to and can be made by one skilled in the art without departing from the teachings of the present invention.

I claim:

1. In a fuel injection pump having a housing, a charge pump having pumping plungers to deliver measured charges of liquid fuel in successive pumping strokes to the cylinders of an associated engine, timing means to vary the timing of the pumping strokes relative to the operation of the associated engine, and actuating means for actuating the timing means for advancing and retarding the timing of the pumping strokes in response to the operating conditions of the associated engine, said actuating means comprising a piston for actuating the timing means and having its ends exposed to fluid chambers at the opposite ends thereof, spring means engaging the piston and a fluid supplied under pressure to one chamber at one end of the piston to bias the piston in the direction to retard the timing, a source of fluid under a regulated pressure correlated with engine speed in communication with the other chamber at the other end of the piston and acting against the bias of the spring means and fluid pressure in said one chamber to advance the timing of the pumping strokes with increased engine speed, said one chamber being connected to said housing, a drainage passageway for draining fluid from the housing to control the pressure in both the housing and said one chamber, valve means between said drainage passageway and the housing for maintaining the fluid pressure in both the housing and said one chamber at a predetermined generally constant pressure and pressure dump means selectively operable to connect the housing to said drainage passageway to dump the said predetermined generally constant pressure in both the housing and said one chamber without affecting the fluid pressure in said other chamber and thereby advance the timing by a predetermined amount.

2. A combination according to claim 1 wherein the pressure dump means comprises means bypassing the valve means.

3. A combination according to claim 1 wherein the valve means is a one-way ball valve and the pressure dump means comprises means for unseating the ball.

4. A combination according to claim 1 wherein the valve means comprises a one-way ball valve and associated spring means urging the ball into seated position, and the pressure dump means comprises means for releasing the pressure of the associated spring means.

5. A combination according to claim 1 wherein the pressure dump means is solenoid operated.

* * * * *